US010269223B2

(12) United States Patent
Kerdemelidis

(10) Patent No.: US 10,269,223 B2
(45) Date of Patent: Apr. 23, 2019

(54) HAPTIC COMMUNICATION APPARATUS AND METHOD

(71) Applicant: Andrew Kerdemelidis, London (GB)

(72) Inventor: Andrew Kerdemelidis, London (GB)

( * ) Notice: Subject to any disclaimer, the term of this patent is extended or adjusted under 35 U.S.C. 154(b) by 0 days.

(21) Appl. No.: 15/097,277

(22) Filed: Apr. 12, 2016

(65) Prior Publication Data

US 2017/0294086 A1 Oct. 12, 2017

(51) Int. Cl.
*G08B 6/00* (2006.01)

(52) U.S. Cl.
CPC ..... *G08B 6/00* (2013.01)

(58) Field of Classification Search
None
See application file for complete search history.

(56) References Cited

U.S. PATENT DOCUMENTS 4,250,637 A * 2/1981 Scott ..... A61F 11/045 340/407.1
4,403,118 A * 9/1983 Zollner ..... H04R 25/353 381/101
6,326,901 B1 * 12/2001 Gonzales ..... G08B 6/00 340/4.12
2009/0024183 A1 * 1/2009 Fitchmun ..... G10L 21/06 607/56
2014/0340298 A1 * 11/2014 Aldossary ..... G06F 3/016 345/156
2015/0040005 A1 * 2/2015 Faaborg ..... H04M 19/047 715/702
2015/0309535 A1 * 10/2015 Connor ..... G06F 1/163 361/679.03
2016/0246378 A1 * 8/2016 Sampanes ..... G06F 3/016

* cited by examiner

*Primary Examiner* — James J Yang
*Assistant Examiner* — Kevin Lau

(57) ABSTRACT

The invention relates to a haptic communication apparatus and method to convert a written message into its constituent phonetic components, which are then encoded as a series of haptic signals that are sensed by the user as a coordinated sensation on a wearable device that incorporates a haptic interface. The coordinated sensations have waveforms and frequencies that correspond to the sounds in the written message when spoken, so that its contents can be intuitively understood by a user without the need for visual or audio cues or to memorize the meaning of entire words.

12 Claims, 15 Drawing Sheets

Electrically isolated (electrode is open-circuit)

Vstim = stimulation voltage active 0V (Ground reference)

HAPTIC COMMUNICATION APPARATUS AND METHOD

FIELD OF THE INVENTION

The present invention relates generally to a haptic communication apparatus and method.

Particularly, but not exclusively, the invention relates to a haptic communication apparatus and method to convert a written message into its phonetic components, encoded as a series of haptic signals that are sensed by the user as a coordinated sensation on a wearable device that incorporates a haptic interface, to facilitate understanding of the written message without the need for audio or visual cues.

BACKGROUND OF THE INVENTION

Social network updates via handheld mobile devices are a popular way for users to be notified of activities and status updates from their social and professional networking, as well as news and other websites that send regular or real-time notifications. Many mobile device applications provide a way of replying to status updates, and also of generating status updates which include GPS locations.

A disadvantage of receiving notifications via a handheld mobile device is that the device normally has to notify the user with a disruptive method that can be heard or perceived by others around, then removed from the pocket, then sometimes must be 'unlocked' to view these notifications and reply to them using an on-screen keyboard interface. Additionally, this can be a slow process, as the user must usually unlock their device, bring up the notification together with the keyboard interface, type their reply, and then have to send it.

Most non-visual notification methods involve audio, even those which have motor-driven 'buzzers' make noise, and can be disruptive in quiet environments, importantly, they offer no refined way of notifying the user of activity requiring their attention in a completely private way. Another disadvantage is that these feedback mechanisms are limited in their ability to provide for different user notifications or to present a user interface to the user that is dependent on the context of the message received. Haptic methods of communication also do not communicate in an intuitive way that allows the content of the notification can be readily understood by a user.

There have been various attempts to develop haptic communication methods which allow more complex messages to be communicated.

MacLean describes the use of a "haptic icon", which is a specific type of haptic stimulus which is designed represent discrete kinds of information (see MacLean, K. E., 2008. Using haptics for mobile information display. In Proceedings of Pervasive Mobile Interaction Devices (PERMID 2008) Workshop, International Conference on Pervasive Computing (pp. 175-179)). Enriquez et al. teach the generation of so-called "haptic phonemes" which are defined as the smallest unit of a constructed haptic signal that can be perceived by a user via a haptic knob. These "haptic phonemes" can be combined serially or in parallel to form 9 distinct stimuli. However, there is no disclosure of a mechanism to facilitate understanding of a written message using haptic sensations that could be understood by a user in an intuitive manner.

Ullrich et al. in U.S. Pat. App. No US20110061017A1 discloses mapping phonemes to "haptic effects" which might simulate speech effects (see para [099]). However, no specific disclosure is included as the mechanism of how this mapping occurs other than an example that sharp haptic effects can be mapped to stressed syllables, softer haptic effects can be mapped to unstressed syllables, and/or combinations of haptic effects can be mapped to phonemes. The simple haptic effects are generated by vibration of an actuator and it is also not disclosed how such mapping can occur in a manner which facilitates understanding of a written message by a user.

Kerdemelidis in U.S. Pat. No. 9,189,932B2 discloses a haptic notification apparatus and method which allows a user to be notified through a haptic interface, allowing notifications to be perceived by a user as coordinated sensations in a pre-defined manner in accordance with the contents of said notification. However, there is no disclosure of a mechanism that facilitates understanding of the written content of such notification by a user in an intuitive manner.

Accordingly, it is an object of the present invention to provide a means for overcoming the above-mentioned problems, or at least providing the public with a useful choice. Further objects and advantages of the present invention will be disclosed and become apparent from the following description.

SUMMARY OF THE INVENTION

The present invention relates generally to a haptic communication apparatus and method.

In a first aspect the invention provides a haptic communication apparatus comprising:

a wireless module configured to receive a notification over a wireless network from a remote device;

a haptic interface proximal to the skin of a user configured to transmit a plurality of haptic stimuli perceived as a coordinated sensation on the skin of said user; and a processor configured to modulate said coordinated sensation on the skin of said user in a pre-defined manner in accordance with the contents of said notification;

wherein said processor modulates said coordinated sensation by deconstructing contents of said notification into a sequence of phonetic components which are mapped in a pre-determined manner to a sequence of coordinated sensations representing each of said phonetic components;

whereby the understanding of said user of the contents of said notification without the need for audio or visual cues is facilitated.

In a second aspect, the invention provides a haptic communication method, the method comprising:

providing a wireless module configured to receive a notification over a wireless network from a remote device;

providing a haptic interface proximal to the skin of a user configured to transmit a plurality of haptic stimuli perceived as a coordinated sensation on the skin of said user;

providing a processor configured to modulate said coordinated sensation on the skin of said user in a pre-defined manner in accordance with the contents of said notification;

wherein said processor modulates said coordinated sensation by deconstructing contents of said notification into a sequence of phonetic components which are mapped in a pre-determined manner to a sequence of coordinated sensations representing each of said phonetic components;

whereby the understanding of said user of the contents of said notification without the need for audio or visual cues is facilitated.

Preferably said phonetic components are further deconstructed into smaller phonetic components which are in turn mapped in a pre-determined manner to a sequence of coordinated sensations representing each of said smaller phonetic components;

Preferably, said processor is configured to modulate the frequency, intensity, overlap, speed, duration, and/or spatial location of said coordinated sensation on said haptic interface in a pre-determined manner in accordance with the contents of said notification.

Preferably, said coordinated sensation comprises at least one waveform having a submodulation frequency, and said processor is configured to modulate the intensity of said waveform in accordance with at least one haptic envelope defining the intervals between at least one said series of phonetic components.

Preferably, at least one coordinated sensation is mapped to at least one phonetic component wherein a plosive phonetic component has a relatively greater intensity and shorter duration, a fricative phonetic component has an aperiodic waveform and relatively longer duration, or a sonorant phonetic component has a periodic waveform of relatively longer duration.

Alternatively, mappings of phonetic components wherein at least one coordinated sensation for a sonorant phonetic component overlaps with the coordinated sensations coding for adjacent phonetic components in said sequence of phonetic components, at least one coordinated sensation for a fricative phonetic component is mapped to a square wave, or at least one coordinated sensation for a phonetic component representing a particular vowel sound is mapped to a sinusoidal or triangular periodic waveform.

Preferably, said processor is configured to modulate the frequency, intensity, overlap, speed, duration and/or spatial location of said coordinated sensation on said haptic interface in a pre-determined manner in accordance with external and environmental factors other than the contents of said notification, including at least one of a group of factors comprising the time of day, the urgency of the message, whether the notification is from work or family, the user's location or proximity to a location, body position, position of the apparatus, ambient light, sound levels, or biofeedback information from a user such as skin conduction, muscle contraction states, heartbeat, or blood pressure.

Preferably, said coordinated sensations representing each of said phonetic components have a duration of between 0.01 ms and 5 seconds.

Preferably said haptic interface is configured to produce said coordinated sensation by providing a plurality of conducting electrodes which activate sensory nerves under skin of said user or via electromechanical means such as a vibrating motor, solenoid, rotary actuator, piezoelectric actuator, or thermal actuator.

More specific features for preferred embodiments are set out in the description below.

BRIEF DESCRIPTION OF THE DRAWINGS

The invention will now be described by way of example only with reference to the accompanying drawings, in which.

DETAILED DESCRIPTION OF THE INVENTION

Figure 1:
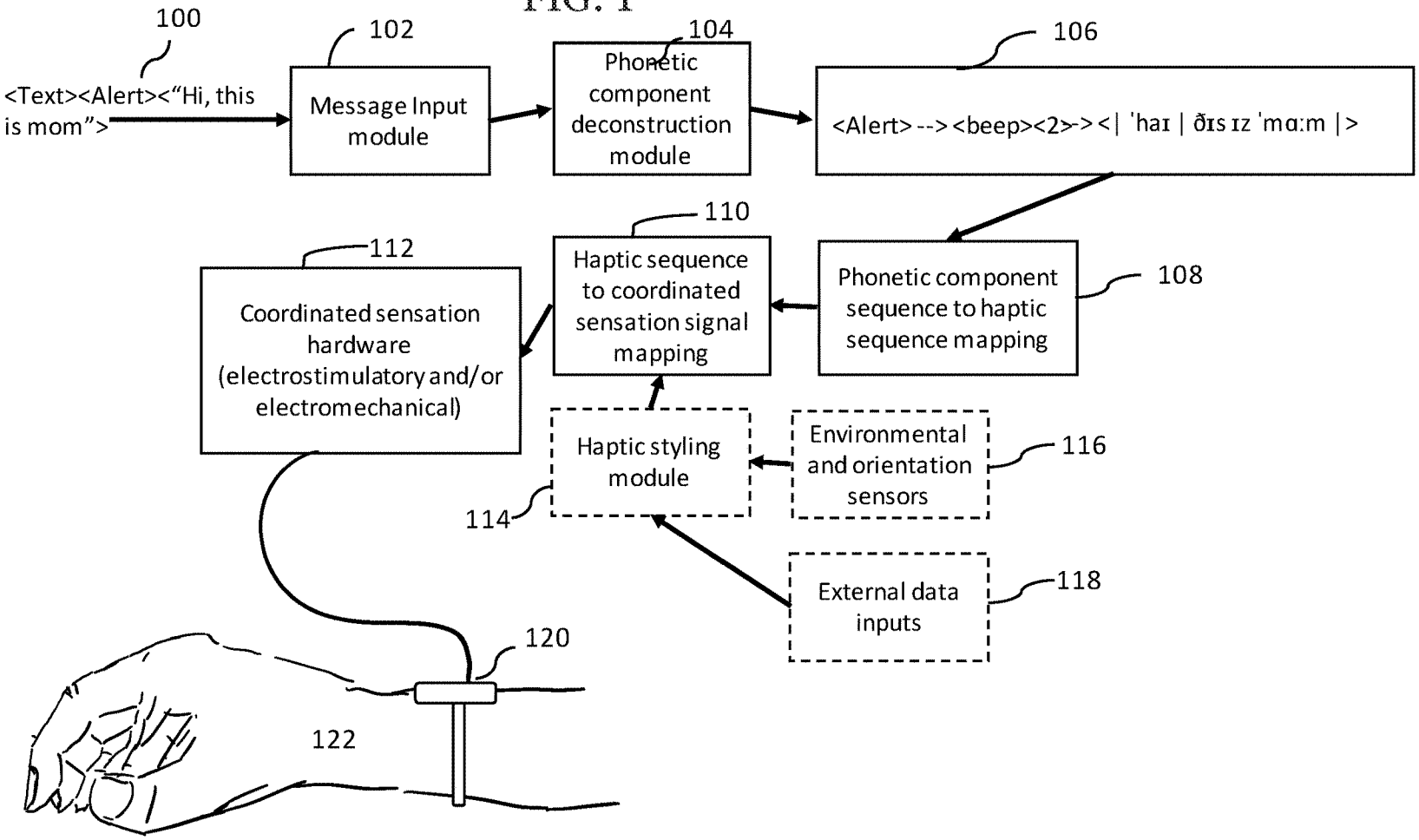
FIG. 1 illustrates the method of operation of an apparatus according to an embodiment of the invention.

Various embodiments of the present invention are described hereinafter with reference to the figures. It should be noted that the figures are only intended to facilitate the description of specific embodiments of the invention. In addition, an aspect described in conjunction with a particular embodiment of the present invention is not necessarily limited to that embodiment and can be practiced in any other embodiments of the present invention.

The present invention relates generally to a haptic communication apparatus and method.

Particularly, but not exclusively, the invention relates to a haptic communication apparatus and method to convert a written message into its phonetic components, encoded as a series of haptic signals that are sensed by the user on a wearable device that incorporates a haptic interface, to facilitate understanding of the written message without the need for audio or visual cues.

In an embodiment of this invention, the user wears a wearable device that is capable of wirelessly receiving messages. A message corresponds to either a feedback signal, word or sentence, 'emoticon' or other form of communication, and according to a phonetic component sequence to haptic sequence rules engine, this message is broken into a sequence of haptic signals, which are then, preferably, played back by a haptic stimulation device at the speed of normal human speech such that the user can understand the meaning of the message itself. For example, if the user has configured a reminder to send them an alert, the device may first render a framing haptics signal, such as a rapidly sequenced series of sawtooth current waveforms, to let the user know that the content of the following haptic message signal is an alert, and then the device renders and appends the content of the alert into a series of coordinated sensations which are played back by a haptic interface on the device. In an alternate embodiment, or using a different style of coordinated sensations that the user prefers, the device may render an alert message by rendering haptic allophones to sensually spell out the word 'ALERT on the skin of a user explicitly followed by the actual content of the message.

Unlike prior art methodologies, which match specific haptic stimuli to whole words, abstract concepts, or ideas (e.g. time, place, meeting), using the described invention it is possible to convert text or "speech" into a series of coordinated sensations which represent the sounds made by the words. In particular, unlike prior art methods, it would not be necessary to memorise a particular sequence of haptic stimuli which represent broad concepts (e.g. alerts or reminders), or perhaps individual letters, rather, with haptic sensations that map to specific phonemes, it may be possible to associate the haptic stimuli with "sounds" so that a user intuitively understands what is being communicated. Once a user learns to associate the coordinated sensations with particular sounds or phonemes, they can intuitively interpret a variety of haptic messages in a natural manner without having to memorise the almost infinite number of ideas that can be communicated using such combination of phonemes. A somewhat crude analogy would be the process whereby a deaf and blind individual may learn to "hear" a large variety of words spoken by resting the fingers of their hand on the speakers lips, throat and nose, sensing the changes in vibrations at the different loci, and thereby "translating" those sensations into the words spoken. For convenience, in this specification the term coordinated sensation may be described as a "haptic phoneme" when it represents a phonetic component comprising a phoneme, although this could also represent other components such as an allophone or any other distinct sound of speech.

The invention generates a coordinated sensation and modulates it to represent a multitude of phonetic components of a message. A coordinated sensation (or haptic phoneme) representing a single phonetic component must have both a waveform (i.e. a specification of the temporal path its signal takes such as a triangle, square, sinusoidal or intermediate waveform) and a frequency (i.e. the rate at which that waveform path is traversed). It can also be varied by overlap with other waveforms, speed, duration, and/or spatial location of said coordinated sensation. Further, it is possible to create an "envelope" around the submodulated waveform (having a higher frequency) which modulates its intensity to help distinguish between allophones, syllables and words (see discussion of FIGS. 10, 11 and 13 below).

The invention can use a pulsed haptic code applied to a common coding method such as morse code, or similar or animated haptic sensations coding individual letters, sounds, syllables or phonemes to be played in sequence, such that a user can understand the actual meaning of a message being sent to them, or can ascertain a visual picture of a concept or communication through it being generated by a haptic stimulation device that is held in contact with a user's skin.

Through decomposing a message sentence into phonemes, and then mapping these into animated haptic signals acting as allophones which are played back on a haptic stimulation device held against a user's skin such that they are felt by a user on that user's skin, it is possible with a minimum of training or practice for a user to intuitively reconstruct the exact sentence, content or meaning of the message being sent to that user from such animated sensations.

Referring now to the drawings, FIG. 1 illustrates the method of operation of an apparatus according to an embodiment of the invention. For the sake of discussion, the haptic communication apparatus is an electronic device having a haptic interface 120, which is worn on the wrist of a user 122. In operation, preferably, a text message 100 is received by a message input module 102, which it is deconstructed into its constituent phonetic components 106 (e.g. phonemes and/or allophones) by a phonetic component deconstruction module 104. At the next step 108, the sequence of phonetic components in the message are mapped to a sequence of haptic signals, and at the next step 110, the haptic signals are mapped to a sequence of coordinated sensations. At this stage it also may be possible that phonetic components comprising phonemes are mapped into smaller constituent phonetic components such as allophones. The coordinated sensation hardware 112 receives the coordinated sensation signal mapping to generate a coordinated sensation on the wrist of a user 122 via a haptic interface 120. Preferably, such coordinated sensation hardware 112 is able to generate any kind of animated sensation on the users skin using electrostimulatory means such as conducting electrodes or electromechanical actuators. The haptic interface generates coordinated sensations which are distinct enough such that a user 122 can resolve the haptic sensing of these into an understanding of the representative phonetic sequence, which furthermore allows a user to reconstruct the message and its meaning. Preferably, a haptic styling module 114 may automatically style, by way of modifying intensity, delay, overlap between coordinates sensations representing phonetic components in phonetic component sequences in a particular way based on information from environmental and orientation sensors 116 and also the external data inputs 118. Such inputs include, but are not limited to the details of the message author, the time of day, the urgency of the message, whether the message is from work or family, the user's location or proximity to a location, body position and corresponding position of the wearable device incorporating the haptic stimulator, biofeedback information from a user such as skin conduction, muscle contraction states, heartbeat, blood pressure, ambient light or sound levels. Preferably, the haptic styling module 114 also allows a user the equivalent of recognizing the voice of the particular contact who has sent the message (the source of the message), including conveyance of its urgency.

The understanding of a message using haptic signals without audio or visual cues is useful in the field of wearable devices, where a user can be engaged in any kind of activity, and without having to look or move, can understand and have 'read' a specific message, continuous or discreet feedback, or alert that has been sent to them.

The coordinated sensation provided on the haptic interface 120 which is sensed by the users 122 can be generated by a number of methods, either severally or in combination. A preferred haptic interface using capacitive coupling is described in applicant's U.S. Pat. No. 9,189,932, incorporated herein by reference. In particular, the preferred method is to use direct electrical stimulation of a combination of Pacinian, Meissners and Lamellar corpuscles under the skin, effected through one or more electrodes that are held against or proximal to the skin, and between any plurality of electrodes, a potential difference can be generated. The electrodes are actuated with a varying voltage signal, sufficient to allow a controlled current of between 1 Nanompere to 500 Amperes, but preferably between 1 milliampere to 1 ampere to flow through the skin's corpuscles such that the user perceives a sensation which varies based on the shape of the current envelope and/or waveform passing through the skin at that location. There are other methods and improvements to electronically stimulate Pacinian and Meissners corpuscles outside of this example, including varying pulse-width of time-varying signals and using higher frequencies than specified, or applying a higher frequency submodulation to a voltage envelope in order to vary its penetrating skin depth or alter the stimulation felt by a user, or by controlling the current flowing through the skin using a constant current controller such that the stimulation of the corpuscles and sensation to the user remains consistent within a widely varying skin conductivity (which varies due to sweat, skin thickness, and contact area).

As noted above, the coordinated sensation hardware 112 may be electromechanical, for example a vibrating motor, solenoid, rotary actuator, piezoelectric actuator, thermal actuator or will, preferentially, involve direct electrical stimulation of the skin, or a combination of all of these methods of stimulation. Those skilled in the art will recognize the variety of methods in combination or in isolation, that are available to stimulate a user's skin such that a coordinated sensation representing a phonetic component can be clearly resolved by that user.

Figure 2:
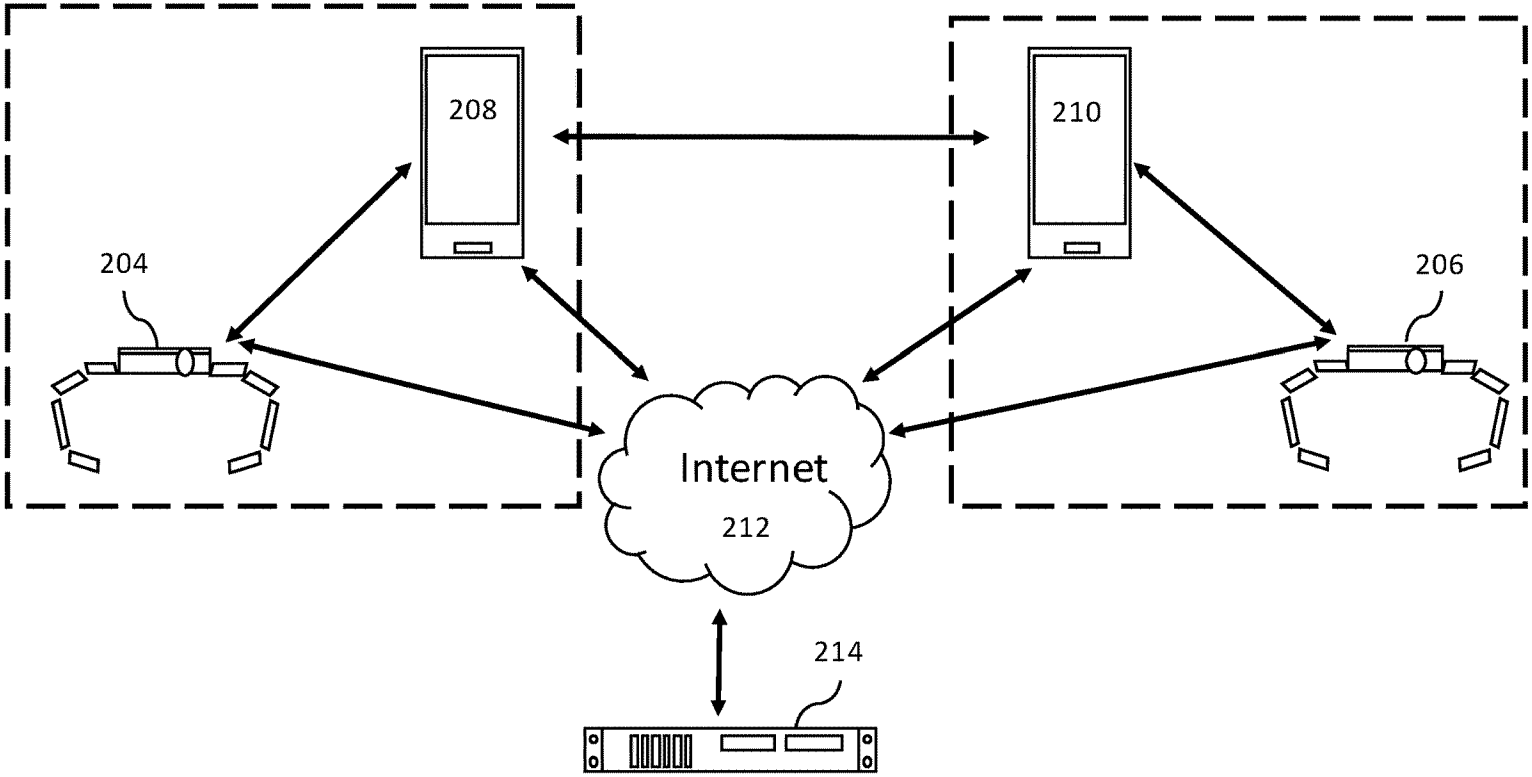
FIG. 2 illustrates a plan view of a communication system according to an embodiment of the invention.

FIG. 2 illustrates a plan view of a communication system according to an embodiment of the invention. In this example, a first haptic communication apparatus 204 is connected to a second haptic communication apparatus either via a first mobile telephone 208 or via the Internet 212. In turn, the second haptic communication apparatus 206 may connect with the first haptic communication apparatus 204 via its respective second mobile telephone 210 or the Internet 212. A server 214 may also connect to each device in the system in order to provide additional support and to assist with processing information where each device may lack processing capacity. For example, the server 214 may convert speech into text, then text into phonetic components and coordinated sensations according to the invention, and provide this information back to each of the haptic interfaces on the devices (not shown).

Figure 3:
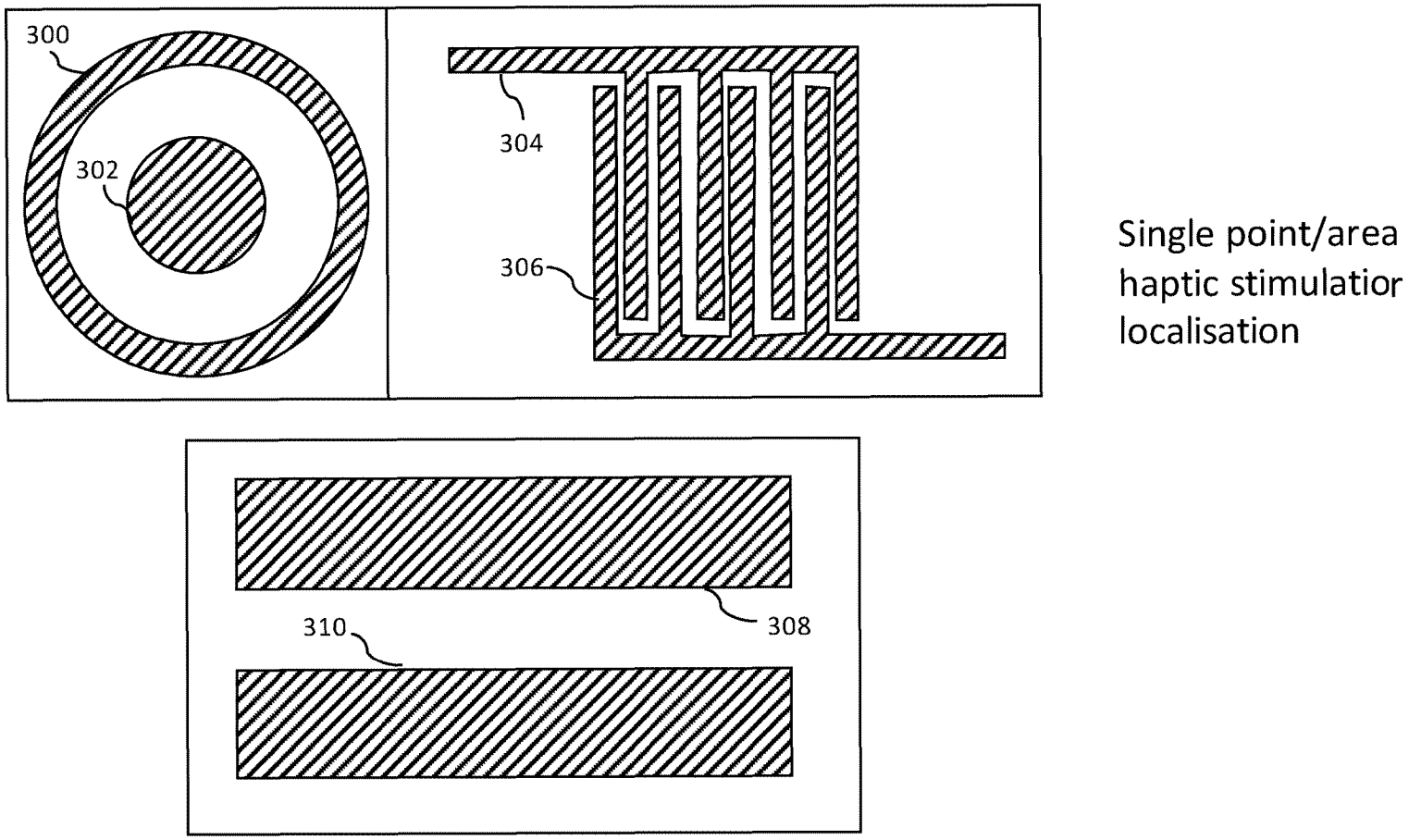
FIG. 3 illustrates a plan view of a haptic interface according to an embodiment of the invention.

A haptic interface can have multiple configurations. For example, in FIG. 3 a single haptic stimulation point is employed where the stimulation is effected at only one point or area of skin that is in contact with the haptic stimulator, and where the point of stimulation itself cannot be changed. For example, this could include a larger circular electrode 300 surrounding a smaller electrode 302, a pair of interlocking electrodes (304, 306), or a pair of parallel electrodes (308, 310).

Figure 4B:
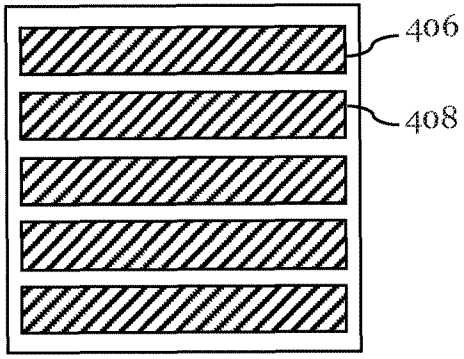
FIGS. 4A and 4B illustrate a plan view of a haptic interface according to an alternative embodiment of the invention.
Figure 4A:
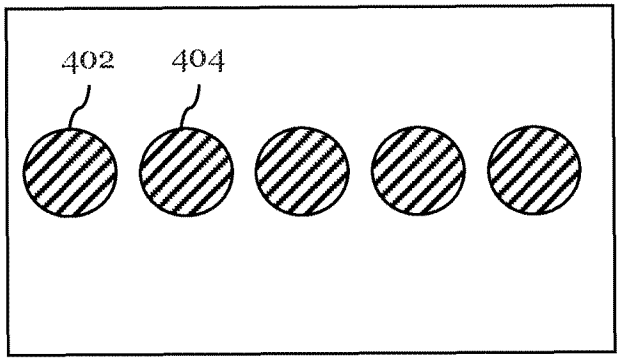

This is in contrast to a one-dimensional or two-dimensional method where stimulation can be more precisely targeted to any point or area by actuating individual electrodes corresponding to the point on the skin on which stimulation is desired. For example, in an alternative embodiment, with reference to FIGS. 4A and 4B, a row of haptic stimulation points (402, 404, 406, 408) are employed in one dimension, and where haptic stimulation can be effected between any points or group of points in that single dimension.

Figure 5B:
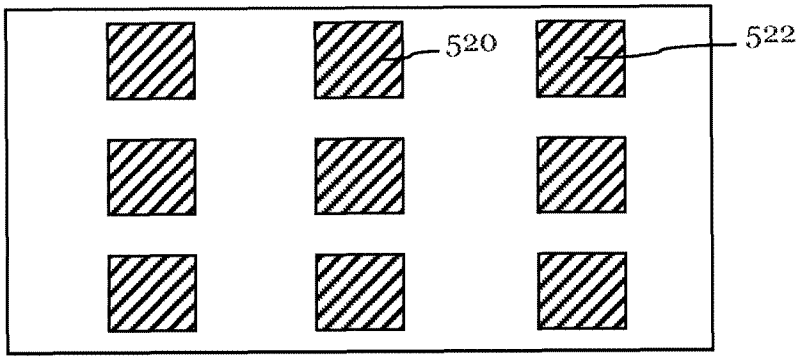
FIGS. 5A and 5B illustrate a plan view of a haptic interface according to an alternative embodiment of the invention.
Figure 5A:
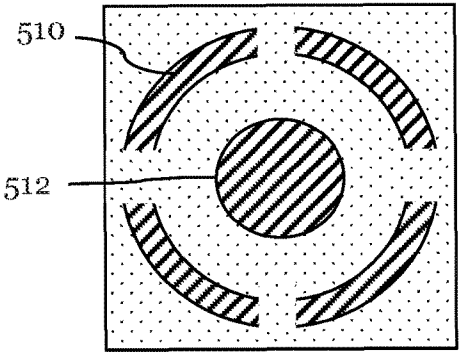

In an alternative embodiment, with reference to FIGS. 5A and 5B, two or more haptic stimulation points are employed, arranged in any arbitrary pattern such that stimulation can be effected on or between any points or groups of points. For example, the haptic interface's electrical potential difference could be effected between the electrodes 510 and 512 shown in FIG. 5A. In a preferred embodiment shown in FIG. 5B, a two-dimensional haptic interface which allows for a localized stimulation anywhere within the active region of a haptic stimulator's skin contact area, for example, by stimulating between the electrodes 520 and 522. Animated excitation of the haptic stimulator can be effected by any part of a haptic allophone sequence, including animation within individual haptic allophones.

In an alternative embodiment, the stimulatory electrodes on a haptic interface are designed such that they are placed on opposite sides of an appendage (hand, finger, neck and other parts of the body) such that current can flow between the two haptic stimulation points. There are several advantages to having spatial control in one or two dimensions in a haptic stimulator. One advantage is that both Pacinian and Meissners corpuscles have a 'recovery time' and are subject to habituation. That is, repeated stimulation over a single area will cause the haptic stimulator to have an increasingly lesser haptic stimulatory effect for the user. By moving haptic stimulation to another area of the skin, through excitation of separate electrodes contacting a different location on the skin, fresh/recovered corpuscles can be stimulated, resulting in a stronger subjective response for the user than if the same area of skin was stimulated and the user habituated to this stimulation.

For the purposes of this invention, an animated haptic phoneme (or its constituent allophone) can last anywhere from a microsecond through to several seconds or more. This can be used to generate a haptic waveform that varies by intensity, frequency, and 2-D location. Optionally, the user can adjust or style the waveform of each haptic phoneme or series of haptic phonemes, including their duration, the overall envelope, current strength, waveform or perceived intensity, and playback speed so that its understandability and comfort for the user is maximized. Distinct haptic phonemes may be partially or completely overlayed on top of each other, such that there is a mixing of the sensations which can, for example, allow a user to perceive one phonetic component blending into another, or for the invention to put emphasis or accent on a particular haptic phoneme, or vary the spacing between playback, to contribute to its understandability, clarity and the users preferred 'style'. In the same way a text font has a particular style suited to the user, a haptic phoneme can also incorporate a style by way of varying the emphasis on elements of each individual phonetic component or group of phonetic components which are being represented. For example, a user who doesn't want to miss a message and is out for a run may opt for haptic signaling that is intense and plays out each haptic phoneme at a faster-than-speech rate, with a space between individual haptic phonemes. A user that is enjoying a night at a restaurant may prefer a softer haptic stimulation in which each haptic phoneme flows into the other, there being overlap between the phonemes, and the playback speed and current intensity being reduced to a level that is more comfortable for the user in that situation.

In order to effect a haptic stimulation, using the electronic method which involves electrical stimulation of the skin, on the haptic interface between a plurality of electrodes, a potential difference can be generated. This potential difference can vary in frequency from DC (Direct Current) through to 1 MHz, and be between 0.1V through to 2 Kilovolts, the intention being that a current flows directly or is induced (in the case of capacitively coupled electrodes) in the epidermis of the users skin which is in contact with the electrodes. Preferably the stimulatory range for the frequency of this potential difference is from DC through to 100 KHz, and the current flowing through the user's skin between the electrodes is between 1 Nanoampere and ten Amperes, and may or may include a sub-modulation frequency to limit stimulation depth (through electrical 'skin effect' where higher frequency voltages will induce currents to flow only on the surface of a conductor). In addition to the ability to effect a potential difference between any electrodes, it is also preferable that individual electrodes may be isolated electrically, that is that they can be used to source or sink current, or be controlled to the point that current sourcing or sinking is switched off such that an electrode can be essentially floating with respect to a ground potential.

Figure 7:
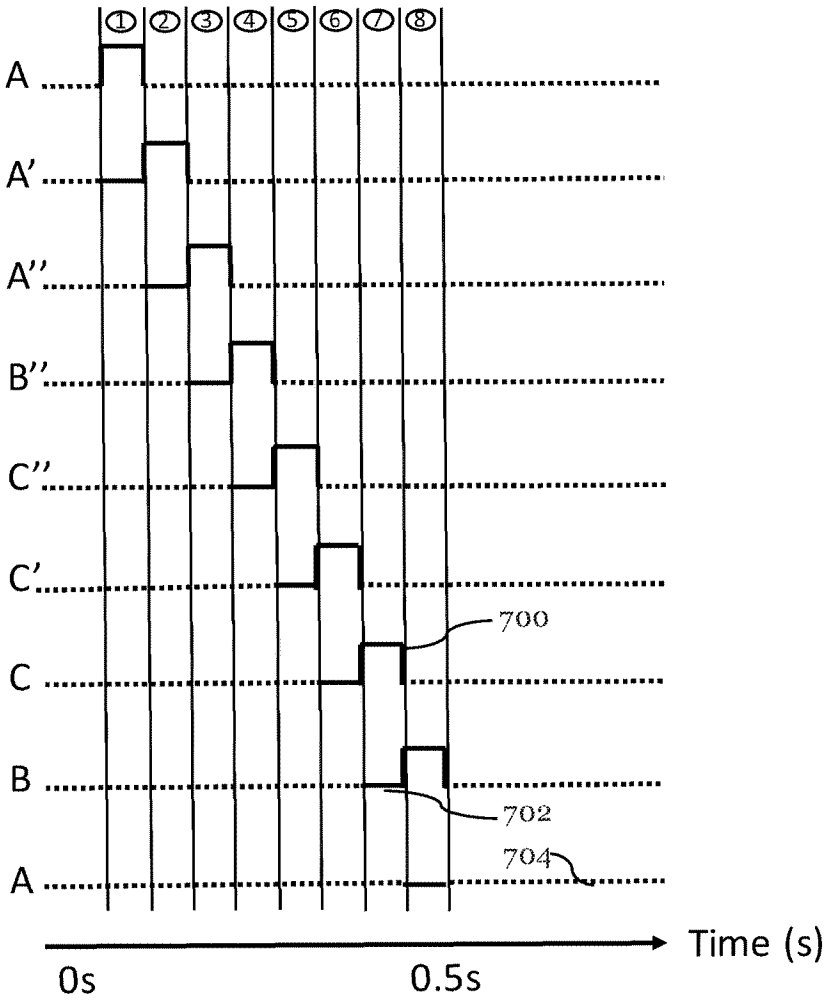
FIG. 7 illustrates a voltage graph representing the coordinated sensation of FIG. 6.
Figure 6:
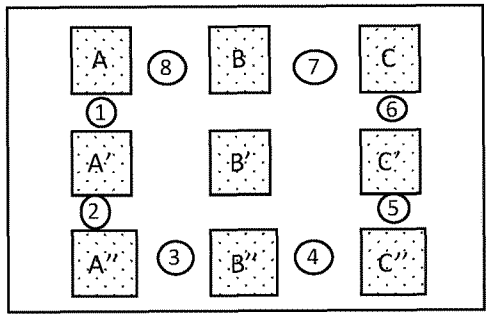
FIG. 6 illustrates a plan view of a haptic interface providing a counter-clockwise coordinated sensation according to an embodiment of the invention.

FIG. 6 illustrates a simple animated haptic sequence that steps through a counter-clockwise sequence from 1 to 8 on a two-dimensional rectangular haptic interface. FIG. 7 illustrates the sequence of FIG. 6 over 0.5 seconds with respect to the changing voltage potentials between each electrode at stimulation voltage 700, no stimulation or ground 700, and the isolation state of those electrodes 704.

Figure 8:
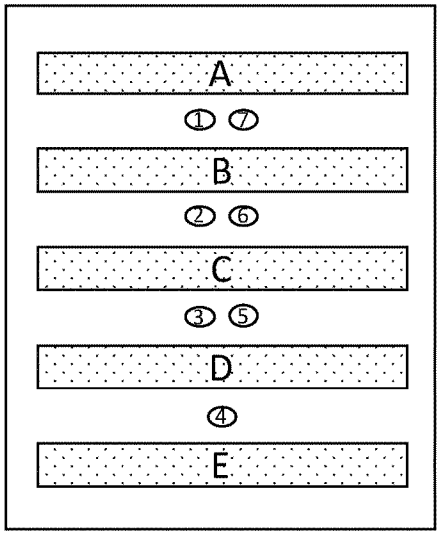
FIG. 8 illustrates a plan view of a haptic interface providing an oscillating coordinated sensation according to an embodiment of the invention.
Figure 9:
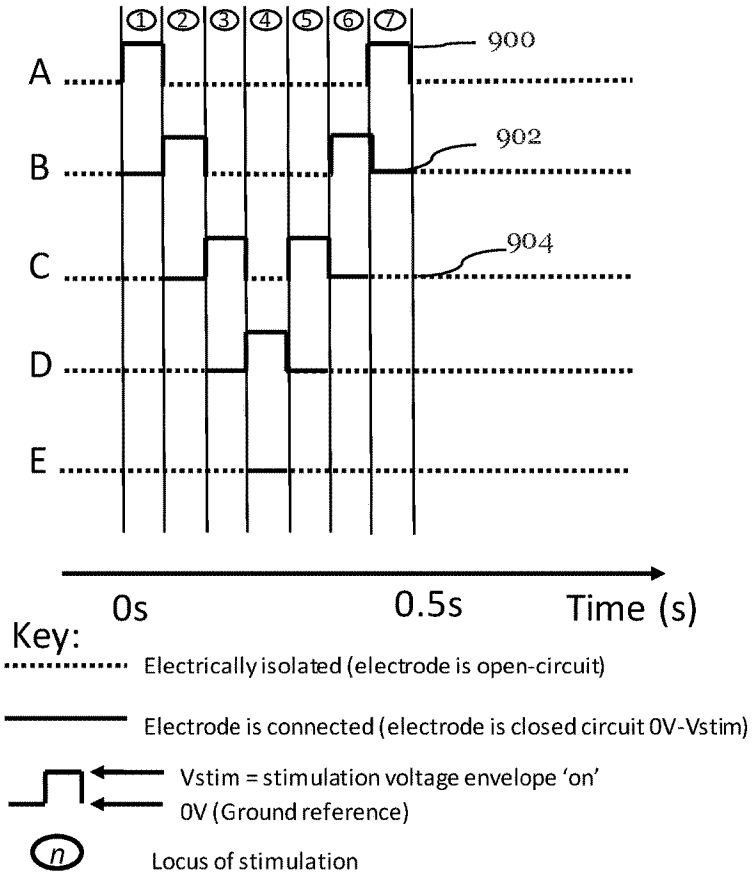
FIG. 9 illustrates a voltage graph representing the coordinated sensation of FIG. 8 according to an embodiment of the invention.

FIG. 8 describes a one-dimensional haptic stimulation implemented in a similar manner to FIG. 6, but moving in one dimension in an oscillating sequence from 1 to 7 on a haptic interface. FIG. 9 illustrates the sequence of FIG. 8 over 0.5 seconds with respect to the changing voltage potentials between each electrode at stimulation voltage 900, no stimulation or ground 902, and the isolation state of those electrodes 704.

Figure 10:
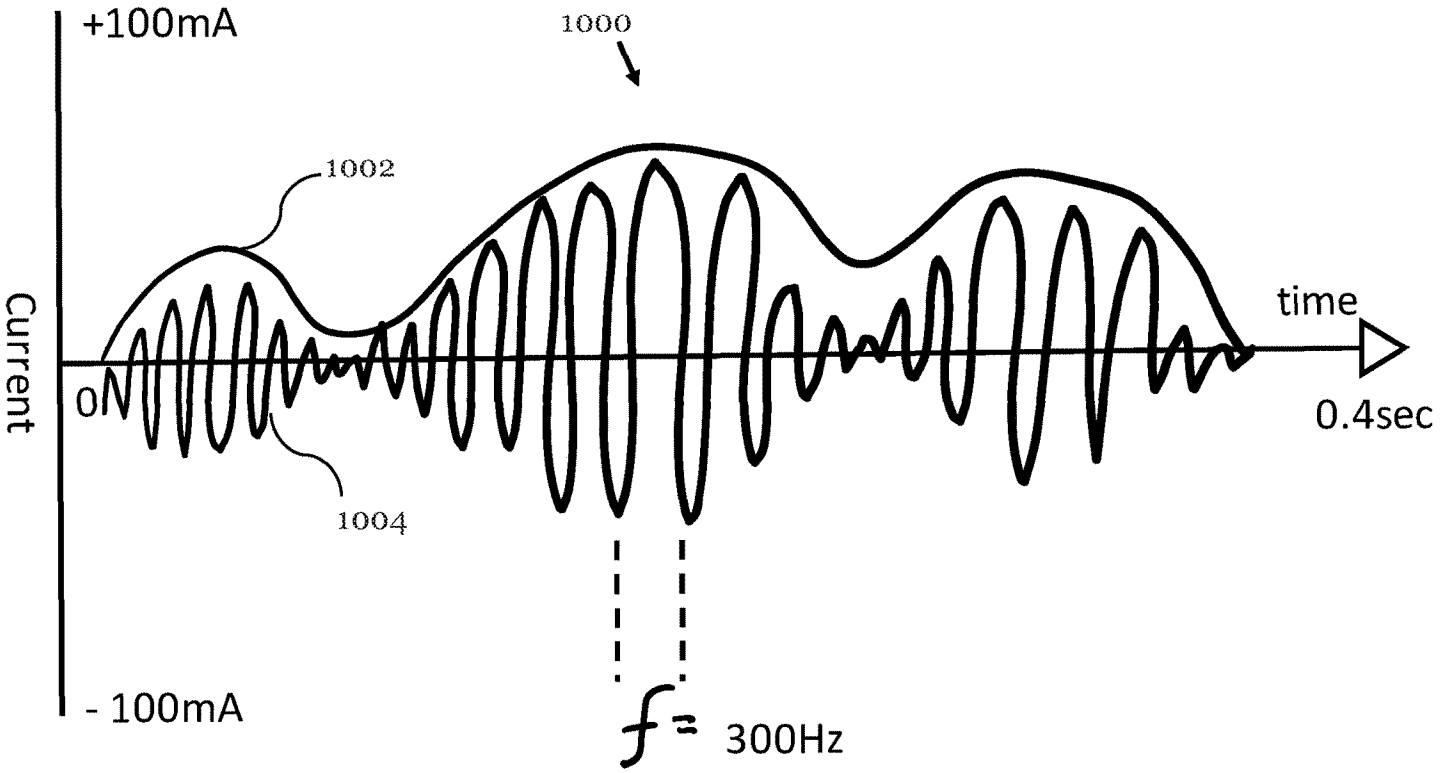
FIG. 10 illustrates a graph representing a haptic envelope with submodulating waveform according to an embodiment of the invention.

FIG. 10 illustrates a graph 1000 representing a haptic envelope 1002 with submodulating waveform 1004 according to an embodiment of the invention. In particular, a haptic stimulation envelope is shown with 300 Hz current source submodulation. This shows how it is possible to modulate the overall waveform in order to apply haptic styling such as differentiating between distinct phonetic components.

Figure 11:
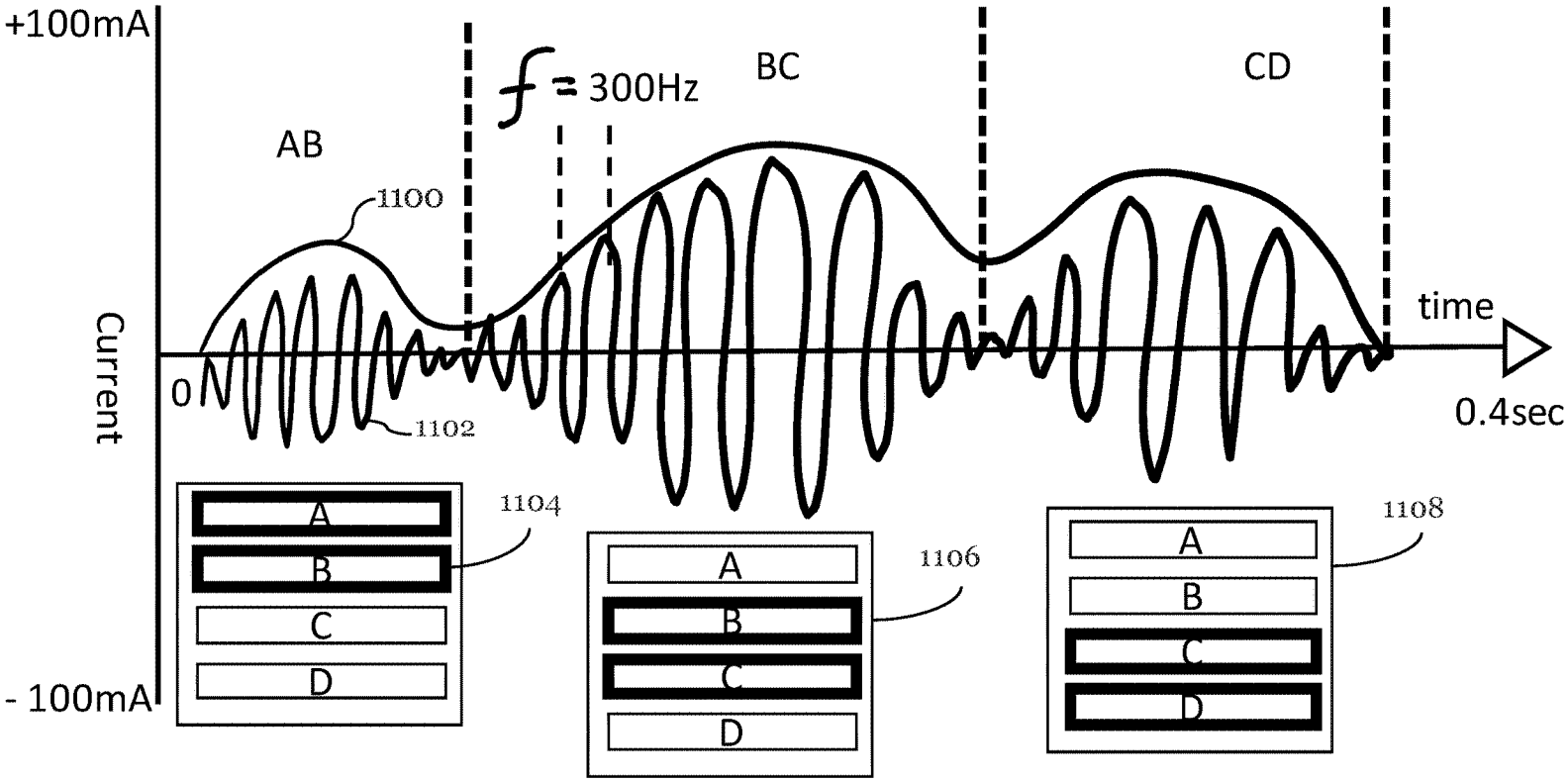
FIG. 11 illustrates a graph representing a haptic envelope with submodulating waveform and haptic interface with varying location of stimuli according to an embodiment of the invention.

FIG. 11 illustrates a graph representing a haptic envelope 1100 with submodulating waveform 1102 and haptic interface with varying location of stimuli according to an embodiment of the invention. In particular, haptic envelope with 300 Hz current source submodulation moving between electrodes AB 1104, BC 1106, and CD 1108. This shows how it it possible to apply haptic styling using a haptic envelope which can vary the intensity of the perceived waveform and to also vary the location of stimulation to encode additional information for the user.

Figure 12:
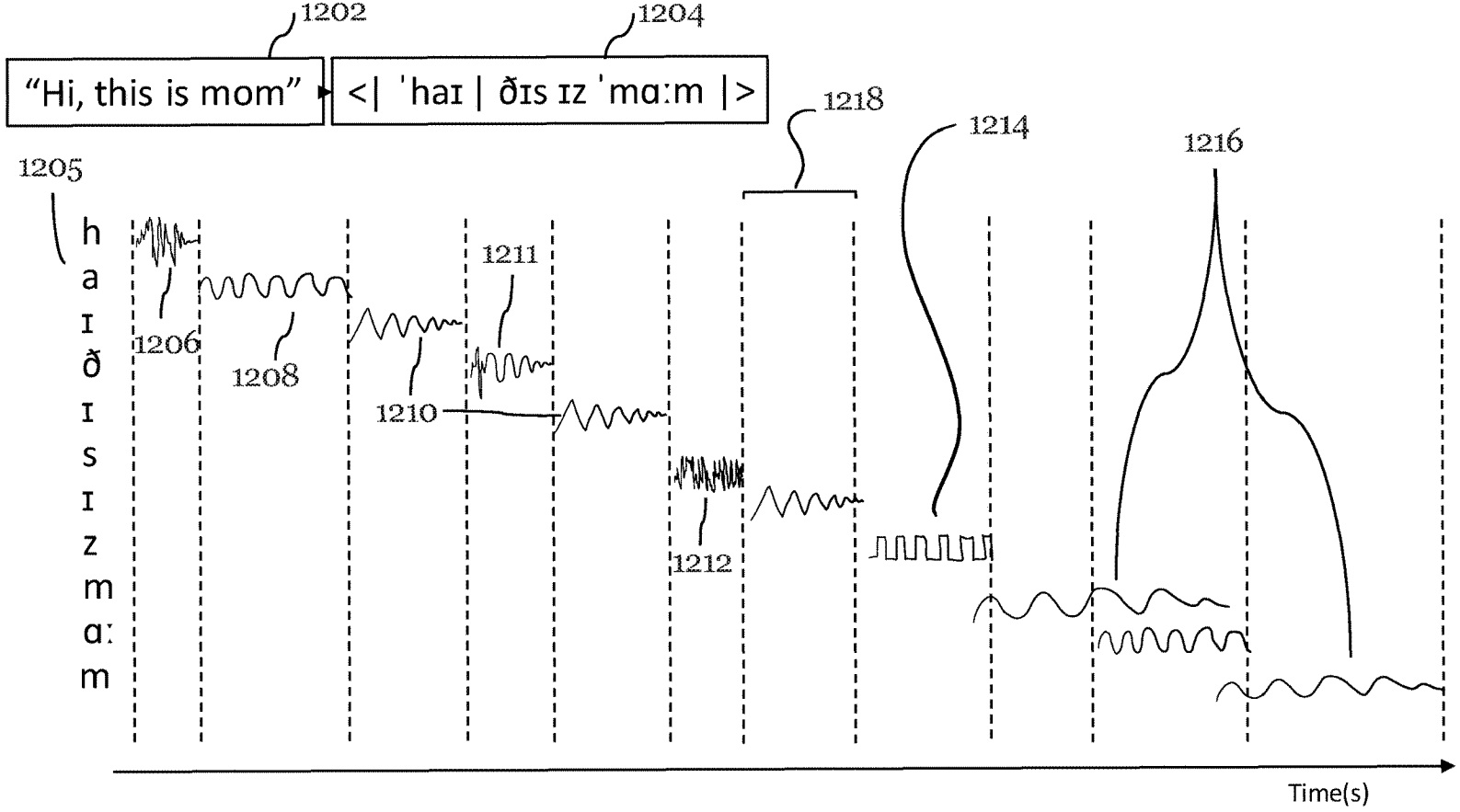
FIG. 12 illustrates a graph representing the deconstruction of contents of a notification into a sequence of phonetic components mapped as a series of coordinated sensations according to an embodiment of the invention.

FIG. 12 illustrates a graph representing the deconstruction of contents of a text notification 1202 into a sequence of phonetic components 1204 mapped as a series of coordinated sensations (e.g. 1206-1218) each representing a distinct phonetic component 1205 according to an embodiment of the invention. For example, the message "Hi, this is mom" 1202 is firstly deconstructed firstly into phonemes which represent the phonetic rendition of the message 1204, then these phonemes are mapped into haptic phonemes or coordinated sensations 1206-1216, which are separated into haptic frames 1218. The haptic frames are concatenated into a sequence and styled as a time-varying haptic envelope signal (as illustrated in FIGS. 10 and 11) which is then sent to a haptic interface (not shown) to stimulate the skin of a user with the content of the message.

The specific mechanism for mapping phonetic components to can vary, but must allow a user to distinguish between them. Preferably the invention utilizes a number of specific ways for the haptic interface to create animated or coordinated sensations to code for unique or partially unique 'soundings' of phonetic components (e.g. phonemes). For example, a plosive sound component of a phoneme (e.g. ([t], [d]), ([k], [g]), ([p], [b]), within a word might animate such that the user would feel a relatively short and intense haptic pulse (less than 0.5 sec in duration) (1211) whereas a fricative (e.g. [f], [s], [z]) could be a subtle aperiodic noise signal that had a hard start and stop and longer duration (1212). A sonorant syllable (e.g. /m/, /n/, /w/, /j/, /l/, /r/) could be coded as feeling like a periodic vibrating or buzzing sensation with a softer start and stop envelope to the haptic signal. Alternative mappings for coordinated sensations to phonemes are possible, for example, a square wave for a fricative (1214) or permitting a coordinated sensation for a sonorant to overlap with the coordinated sensations coding for adjacent phonetic components (1216). In addition, the sound of "a" may be encoded with a sinusoidal periodic waveform (1208), and "i" may be encoded as a triangular periodic waveform (1210).

Figure 13:
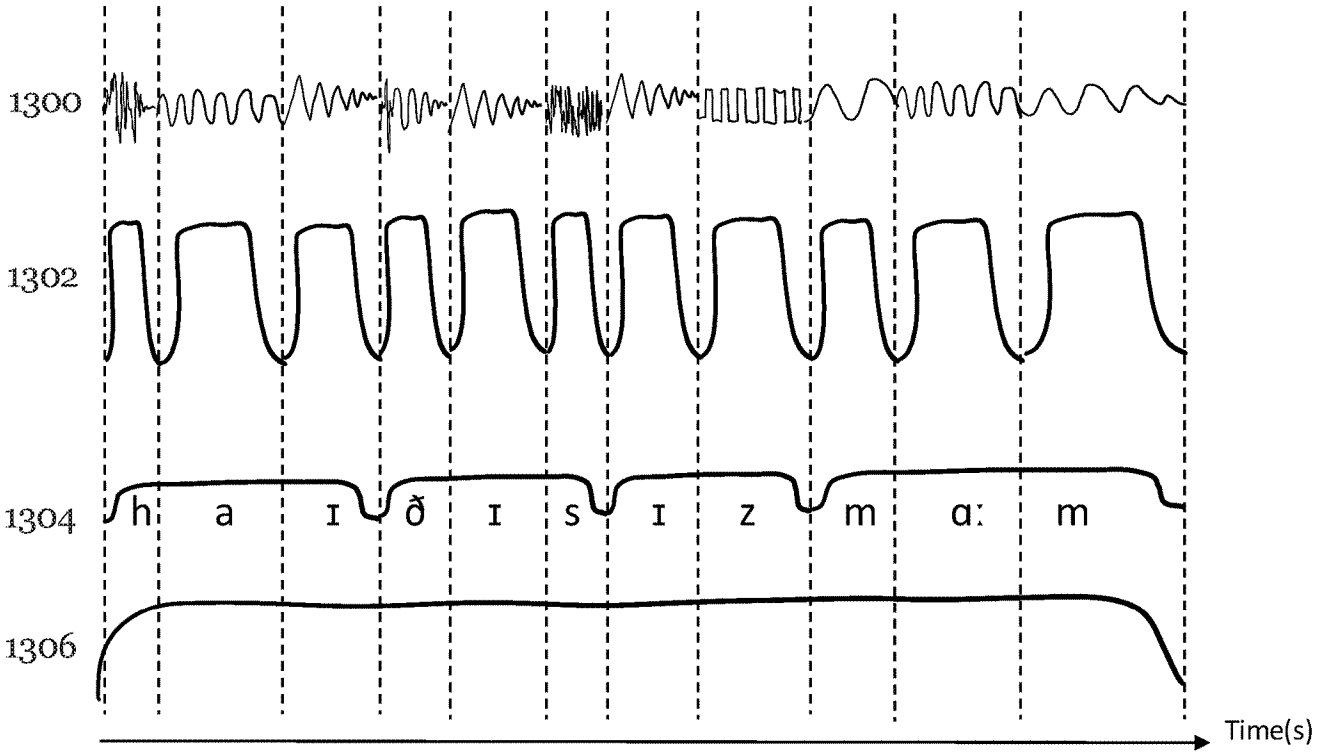
FIG. 13 illustrates a graph representing a series of coordinated sensations where a haptic envelope is applied to each allophone, word and phrase according to an embodiment of the invention.

FIG. 13 illustrates a graph representing a series of coordinated sensations where a haptic envelope is applied to each allophone, word and phrase according to an embodiment of the invention. In particular, a series of concatenated haptic phonemes 1300 within haptic frames are shown. The waveform of each haptic phoneme in the sequence 1300 is subject to further signal styling to apply amplification of intensity on a per-frame 1302 per word 1304 and per phrase 1306 basis.

Figure 14:
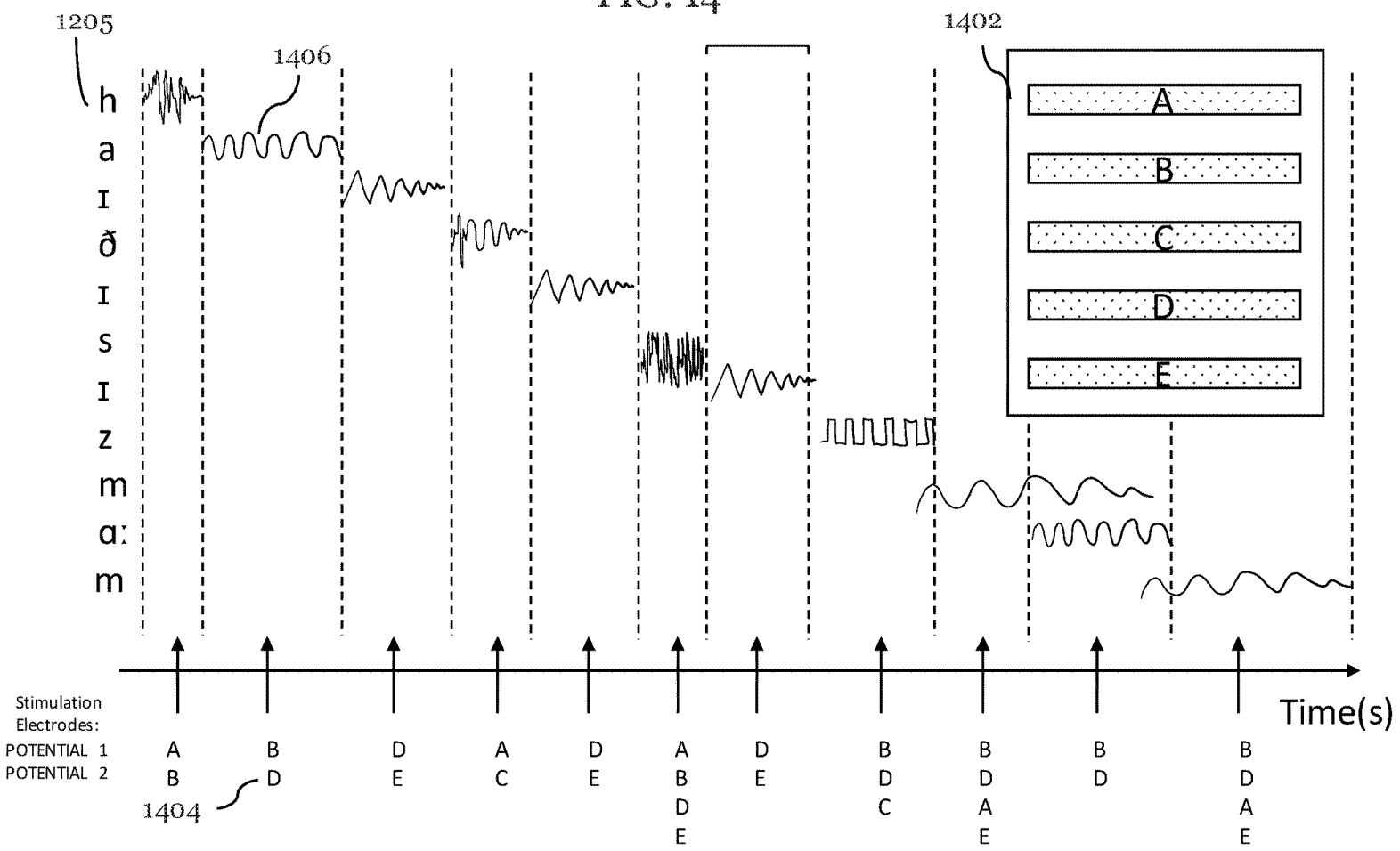
FIG. 14 illustrates a graph representing a series of coordinated sensations with varying location of stimuli according to an embodiment of the invention.

FIG. 14 illustrates a graph representing a series of coordinated sensations with varying location of stimuli according to an embodiment of the invention. The phonetic components 1205 are deconstructed into haptic phonemes as per FIG. 12, however, with the inclusion of electrodes 1402 which vary the 2-D location of the stimulus applied on the haptic interface at various time intervals 1404.

Figure 15:
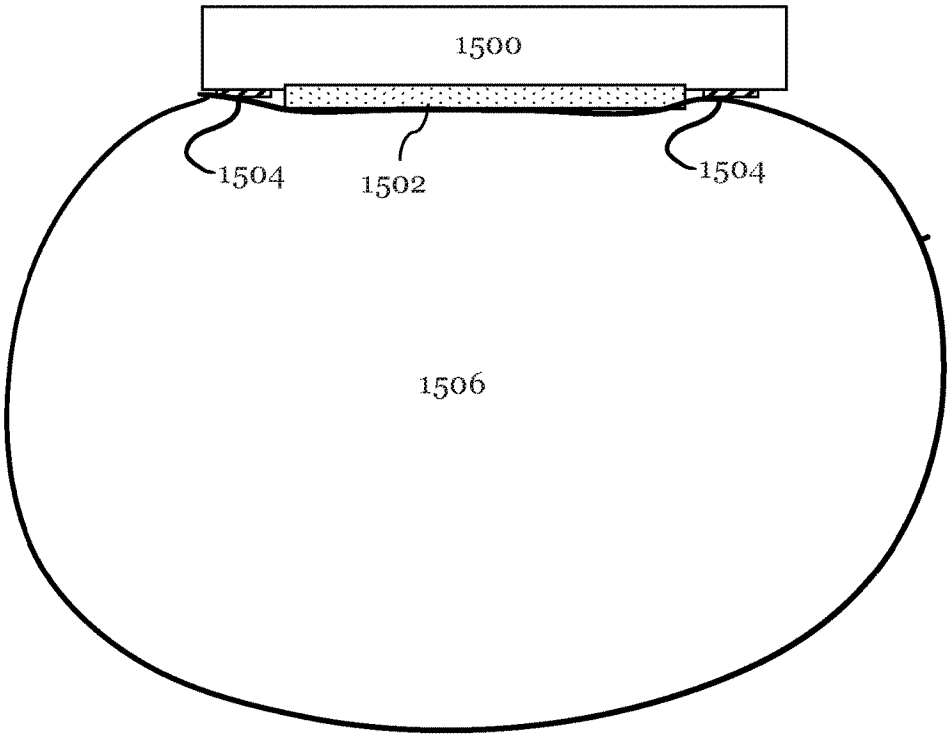
FIG. 15 illustrates a side view of a haptic communication apparatus with contact sensors according to an embodiment of the invention.
Figure 16:
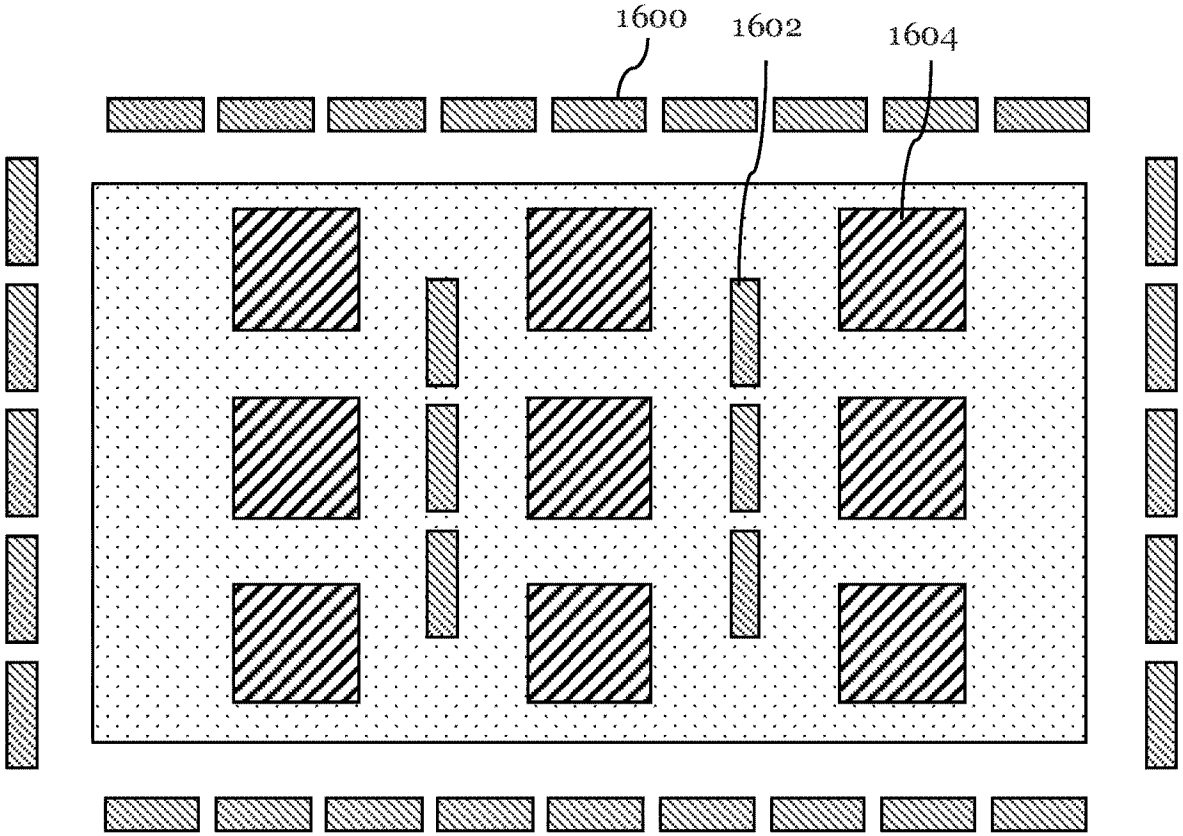
FIG. 16 illustrates a plan view of a haptic interface with contact sensors according to an alternative embodiment of the invention.

In addition to the electrode arrays described, it is important to control current density at the electrode contact points on the skin. In order to do this, it is necessary to incorporate sensing that can determine the area of skin in contact with individual electrodes, since along with frequency of actuation, it is also the current density flowing through a Pacinian or Meissner's corpuscle that determines what intensity of sensation the user will feel on their skin. Thus, in order to provide for the generation of consistent sensations, the contact area of electrodes must also be able to be determined. If the current density is too high on a contact point on the skin, the user may experience discomfort or pain when the haptic stimulator has been actuated, due to the current, although controlled, flowing into a much smaller area of skin than anticipated and overstimulating the corpuscles or causing unwanted thermal or chemical effects. Two methods of implementing safe haptic stimulation will be described, however to those skilled in the art it will be apparent that there are many other methods to ascertain electrode contact area, including but not limited to; optical sensors such as are used in optical heartbeat detection, or separate sensing electrodes between an area of skin, to ensure that all the electrodes on the device are in complete or near-complete contact with the user's skin. This latter method is shown in FIG. 15 and works by having two skin conductance sensor bars 1504 placed at a distance across from each other on either side of a haptic interface 1502. The haptic interface 1502 is shown atop a cross-section of a users' wrist 1506. The skin's conductance will vary between 300 Ohms-150 Kilo Ohms, and if the skin is in contact with both electrodes 1504 then it can be assumed that the full area of the haptic stimulation array will be in complete contact with the users skin. If both of the electrodes are not contacting the skin such that the electrical resistance between them is greater than 150 Kilo Ohms, then it is assumed that the haptic stimulator is not in complete contact with the skin, and the device could then disable the haptic stimulator, or lower the stimulation current such that the user will not feel discomfort from the current density being too high where an electrode is in partial contact with the skin. It is possible to incorporate such a contact area sensor using the haptic stimulation electrodes themselves, and measure the skin resistance between each pair of electrodes, in particular the electrodes around the periphery of the haptic interface device. It is also possible as shown in FIG. 16 to have a plurality of measurement electrodes or optical proximity sensors either interspersed between 1602 the electrodes 1604 or around the periphery (1600) Such measurement can be effected either during or between electrical haptic stimulation events or even continuously, and is used to modulate both the current and voltages between the haptic stimulator electrodes such that it is ensured that the users sensations remain consistent and that the user is free from any discomfort.

Figure 17:
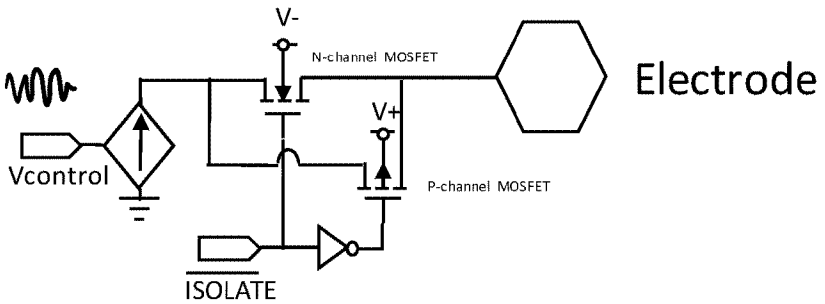
FIGS. 17 and 18 illustrate circuit diagrams showing the isolation and control of an electrode according to an embodiment of the invention.
Figure 18:
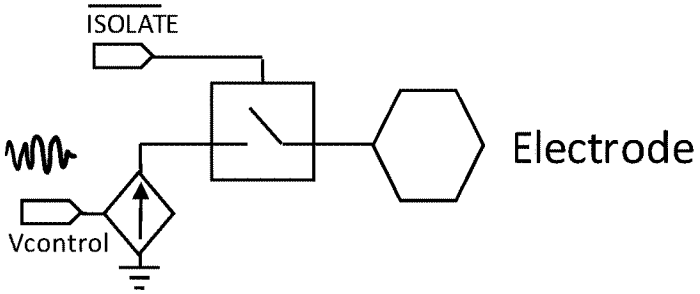

FIGS. 17 and 18 show examples of an isolatable current source used to control whether an electrode can source or sink current. Each electrode in can be selectively electrically isolated, (for example, using a technology such as a MOSFET or similar high-speed solid-state current controller) to control the resistance or impedance an electrode has such with respect to the actuating potential difference, the current in Amperes being able to be sourced or sunk from any electrode can be controlled continuously from a maximum down to near-zero.

Figure 19:
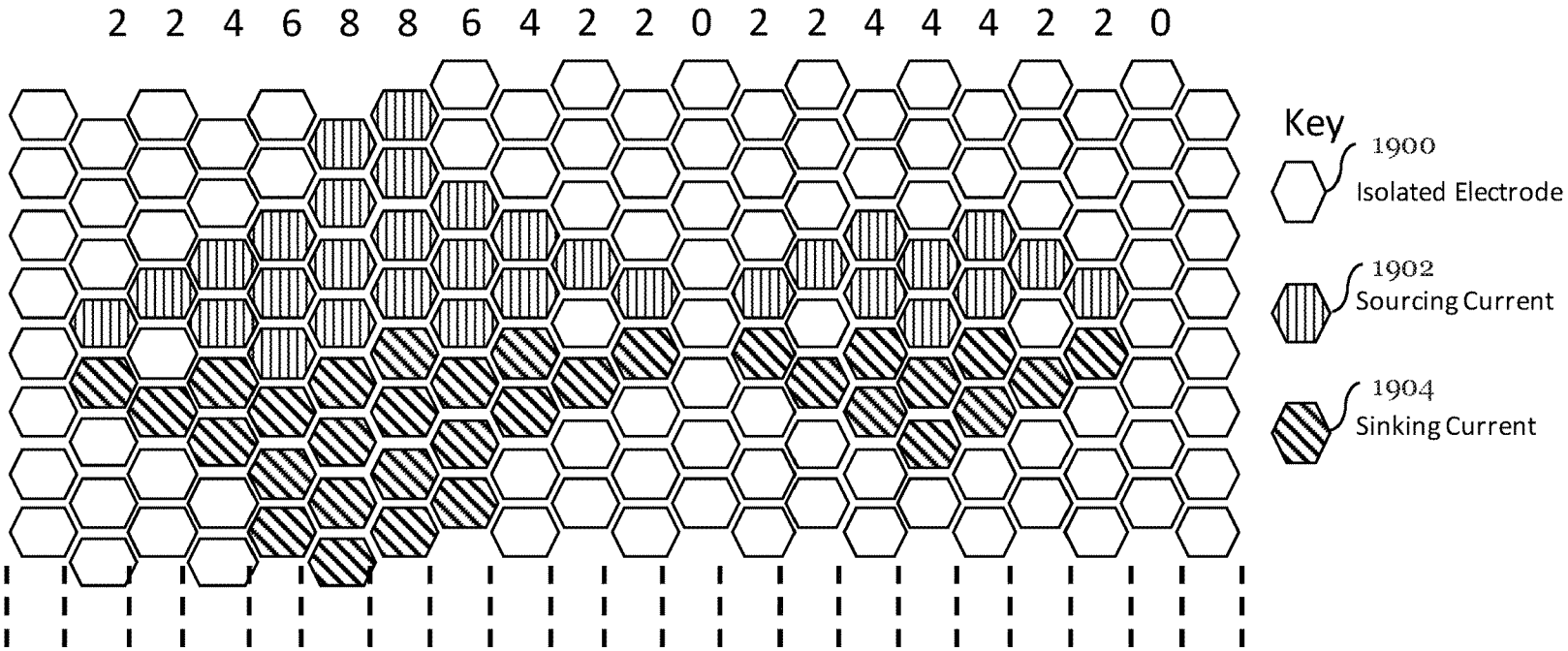
FIG. 19 illustrates a plan view of a haptic interface on a hexagonal array, according to an embodiment of the invention.

FIG. 19 illustrates a plan view of a haptic interface on a hexagonal array, according to an alternative embodiment of the invention. An isolated electrode 1900 is shown, as well as a sourcing current 1902 and sinking current 1904. The advantage of selective electrical isolation of the electrodes of the haptic stimulator is mainly for 1 and 2 dimensional electrode arrays. The benefit of controlled electrical isolation of the electrodes is that better control of the localisation of a haptic stimulatory effect can be had, since the stimulation current will only flow through the skin between electrodes that are actuated to have a voltage potential between them.

Other forms of haptic interfaces are possible, which may vary in size, shape and location on the skin of a user (for example, headbands, leg bands, and waist bands). Provided that a user can distinguish between individual haptic phonemes, it may not be important how the stimulation is communicated to the user with the haptic interface, provided that it can be perceived.

While the invention has been illustrated and described in detail in the foregoing description, such illustration and description are to be considered illustrative or exemplary and non-restrictive; the invention is thus not limited to the disclosed embodiments. Features mentioned in connection with one embodiment described herein may also be advantageous as features of another embodiment described herein without explicitly showing these features. Variations to the disclosed embodiments can be understood and effected by those skilled in the art and practicing the claimed invention, from a study of the disclosure and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A haptic communication apparatus comprising:

a wireless module configured to receive a notification over a wireless network from a remote device;

a haptic interface proximal to the skin of a user configured to transmit a plurality of haptic stimuli perceived as a coordinated sensation on the skin of said user;

a processor configured to modulate said coordinated sensation on the skin of said user in a pre-defined manner in accordance with the contents of said notification;

means for electrically isolating a first pre-determined group of said plurality of conducting electrodes and allowing a stimulating current to flow between a second pre-determined group of said plurality of conducting electrodes in a controlled manner such that a coordinated sensation is generated;

wherein said processor modulates said coordinated sensation by deconstructing contents of said notification into a sequence of phonetic components which are mapped in a pre-determined manner to a sequence of coordinated sensations representing each of said phonetic component;

wherein at least one coordinated sensation is mapped to at least one phonetic component wherein a plosive phonetic component has a relatively greater intensity and shorter duration, a fricative phonetic component has an aperiodic waveform and relatively longer duration, and a sonorant phonetic component has a periodic waveform of relatively longer duration;

wherein at least one coordinated sensation for a sonorant phonetic component overlaps with the coordinated sensations coding for adjacent phonetic components in said sequence of phonetic components, at least one coordinated sensation for a fricative phonetic component is mapped to a square wave, and/or at least one coordinated sensation for a phonetic component representing a particular vowel sound is mapped to a sinusoidal or triangular periodic waveform;

wherein said haptic interface is configured to produce said coordinated sensation by providing a plurality of conducting electrodes which activate sensory nerves under skin of said user;

wherein said coordinated sensations represent each of said phonetic components and have a waveform and frequency corresponding to the sound of a written notification when spoken in normal speech.

2. The haptic communication apparatus of claim 1 wherein said phonetic components are further deconstructed into smaller phonetic components which are in turn mapped in a pre-determined manner to a sequence of coordinated sensations representing each of said smaller phonetic components.

3. The haptic communication apparatus of claim 1 wherein said processor is configured to modulate the frequency, intensity, overlap, speed, duration, and spatial location of said coordinated sensation on said haptic interface in a pre-determined manner in accordance with the contents of said notification.

4. The haptic communication apparatus of claim 1 said coordinated sensation comprises at least one waveform having a submodulation frequency, and said processor is configured to modulate the intensity of said waveform in accordance with at least one haptic envelope defining the intervals between at least one said series of phonetic components.

5. The haptic communication apparatus of claim 1 wherein said processor is configured to modulate the frequency, intensity, overlap, speed, duration and/or spatial location of said coordinated sensation on said haptic interface in a pre-determined manner in accordance with external and/or environmental factors other than the contents of said notification, including at least one of a group of factors comprising the time of day, the urgency of the message, whether the notification is from work or family, the user's location or proximity to a location, body position, position of the apparatus, ambient light, sound levels, or biofeedback information from a user such as skin conduction, muscle contraction states, heartbeat, or blood pressure.

6. The haptic communication apparatus of claim 1 wherein said coordinated sensations representing each of said phonetic components have a duration of between 0.01 ms and 5 seconds.

7. A haptic communication method comprising: providing a wireless module configured to receive a notification over a wireless network from a remote device;

providing a haptic interface proximal to the skin of a user configured to transmit a plurality of haptic stimuli perceived as a coordinated sensation on the skin of said user; providing a processor configured to modulate said coordinated sensation on the skin of said user in a pre-defined manner in accordance with the contents of said notification; wherein said processor modulates said coordinated sensation by deconstructing contents of said notification into a sequence of phonetic components which are mapped in a pre-determined manner to a sequence of coordinated sensations representing each of said phonetic components;

means for electrically isolating a first pre-determined group of said plurality of conducting electrodes and allowing a stimulating current to flow between a second pre-determined group of said plurality of conducting electrodes in a controlled manner such that a coordinated sensation is generated;

wherein at least one coordinated sensation is mapped to at least one phonetic component wherein a plosive phonetic component has a relatively greater intensity and shorter duration, a fricative phonetic component has an aperiodic waveform and relatively longer duration, and a sonorant phonetic component has a periodic waveform of relatively longer duration;

wherein at least one coordinated sensation for a sonorant phonetic component overlaps with the coordinated sensations coding for adjacent phonetic components in said sequence of phonetic components, at least one coordinated sensation for a fricative phonetic component is mapped to a square wave, and/or at least one coordinated sensation for a phonetic component representing a particular vowel sound is mapped to a sinusoidal or triangular periodic waveform;

wherein said haptic interface is configured to produce said coordinated sensation by providing a plurality of conducting electrodes which activate sensory nerves under skin of said user;

wherein said coordinated sensations represent each of said phonetic components and have a waveform and frequency corresponding to the sound of a written notification when spoken in normal speech.

8. The haptic communication method of claim 7 wherein said phonetic components are further deconstructed into smaller phonetic components which are in turn mapped in a pre-determined manner to a sequence of coordinated sensations representing each of said smaller phonetic components.

9. The haptic communication method of claim 7 wherein said processor is configured to modulate the frequency, intensity, overlap, speed, duration, anti/or spatial location of said coordinated sensation on said haptic interface in a pre-determined manner in accordance with the contents of said notification.

10. The haptic communication method of claim 7 said coordinated sensation comprises at least one waveform having a submodulation frequency, and said processor is configured to modulate the intensity of said waveform in accordance with at least one haptic envelope defining the intervals between at least one said series of phonetic components.

11. The haptic communication method of claim 7 wherein said processor is configured to modulate the frequency, intensity, overlap, speed, duration and/or spatial location of said coordinated sensation on said haptic interface in a pre-determined manner in accordance with external and/or environmental factors other than the contents of said notification, including at least one of a group of factors comprising the time of day, the urgency of the message, whether the notification is from work or family, the user's location or proximity to a location, body position, position of the apparatus, ambient light, sound levels, or biofeedback information from a user such as skin conduction, muscle contraction states, heartbeat, or blood pressure.

12. The haptic communication method of claim 7 wherein said coordinated sensations representing each of said phonetic components have a duration of between 0.01 ms and 5 seconds.

* * * * *